United States Patent [19]

Allen

[11] Patent Number: 4,702,129

[45] Date of Patent: Oct. 27, 1987

[54] GRIPPER FOR CONTAINER CAPS

[76] Inventor: Louis Allen, 166 E. 61st St., New York, N.Y. 10021

[21] Appl. No.: 804,048

[22] Filed: Dec. 2, 1985

[51] Int. Cl.[4] ..... B67B 7/44

[52] U.S. Cl. ..... 81/3.09; 81/3.4

[58] Field of Search ..... 81/3.4, 3.07, 3.09

[56] References Cited

U.S. PATENT DOCUMENTS 1,960,531 5/1934 Driscoll ..... 81/3.4

3,604,290 9/1971 Waite ..... 81/3.4

*Primary Examiner*—Roscoe V. Parker

*Attorney, Agent, or Firm*—Natter & Natter

[57] ABSTRACT

A gripper for allowing a twist or screw type container cap to be removed with relatively little exertion by a person's hand, includes a generally solid body of rubber-like resilient material, the body having a recess in which a container cap can be snuggly fitted regardless of the cap size within a determined range of cap sizes. The body material is sufficiently elastic, in the region of the recess, to conform substantially to the outer periphery of the inserted container cap, so that an opening force is applied by the material to the outer periphery of the cap when the body is twisted by the user's hand and the cap is restrained by its associated container from rotation with respect to the gripper body.

8 Claims, 5 Drawing Figures

GRIPPER FOR CONTAINER CAPS

BACKGROUND OF THE INVENTION

1. Field of the Invention

The present invention relates generally to container cap removers, and particularly to a gripper device which is formed of a generally solid body of rubber-like resilient material and has one or more recesses for snuggly fitting container caps within given size ranges.

2. Description of the Known Art

Hand held devices for removing twist off screw caps from containers are known generally. Some of the known devices are formed so as to engage the outer periphery of a container cap at discrete point locations with a corresponding number of blades or metal edges which are contained within a hard plastics shell. An example of such cap opening device is disclosed in U.S Pat. No. 3,730,025 issued May 1, 1973. The device of the '025 patent comprises a disc-shaped plastics shell having a conical socket, and typically four metal blades having edges which are stepped and project slightly from the wall of the recess at evenly spaced locations on the periphery of the recess wall. In order to remove a tightly closed bottle cap, the user places the shell of the device down over the cap so as to cause each of the blades to engage the cap firmly at a certain step, and then twists the shell while holding the bottle with the other hand.

It will be appreciated that since the device engages the bottle cap at only four individual point locations on the cap periphery, and only those cap sizes which correspond to the steps formed on the blades can be opened with the device, it has certain disadvantages. First, since a substantial force is imparted from each of the blades to the bottle cap at the points of engagement, gouging of the cap is bound to occur. Such result may not be desirable in cases where the contents of a container are not consumed all at one time and the container is ordinarily openly displayed, e.g., medicine containers, spice jars, perfume bottles and the like.

Second, if a cap to be opened does not fit snuggly in the blade steps due to the size or shape of the cap, the device becomes virtually unusable and the blades may even be damaged if the user exerts enough force while trying to open a cap which is improperly seated in the blades.

A cap gripping device is also known from U.S. Pat. No. 3,604,290 issued Sept. 14, 1971. The device of the '290 patent also includes a body member of rigid plastics material in a frustoconical shape. A correspondingly shaped recess in the shell is lined with a gripping member of resilient material the inner surface of which is slotted by a series of tapered grooves. The device is used substantially in the same way as the gripper of the '025 patent described above, and also requires the exertion of some downward force to maintain frictional engagement with a cap to be removed, while the user twists the device with one hand.

Other known screw cap removers are in the form of a sheet of resilient material such as vinyl rubber, and operate merely by allowing a part of the sheet to be wrapped about the periphery of the cap while the user holds the sheet and attempts to twist the cap through frictional engagement between the sheet and the cap. Two examples of such cap removers are disclosed in U.S. Pat. Nos. 4,090,419 issued May 23, 1978, and U.S. Pat. No. 2,880,633 issued Apr. 7, 1959.

A vinyl sheet rubber jar and cap remover is also disclosed in U.S. Pat. No. 2,985,044 issued May 23, 1961. The cap remover of the '044 patent comprises a number of superimposed concentric circular ring-like portions of various diameters, each ring portion presenting a vertical inner face wall. In use, a container cap having a diameter which most closely approximates one of the concentric portions is received in that portion, and the corresponding inner face wall is pressed against the periphery of the cap when the user grips the exterior face of the selected circular portion and squeezes the wall of that portion against the cap while attempting to twist the cap off of the container. It will be appreciated, however, that the cap remover of the '044 patent has the disadvantage that it does not accommodate an infinite number of cap diameters within a given range, and the inner face wall of a non-accommodating ring-like portion will not firmly grip the periphery of an odd cap. Accordingly, when a twist force is exerted by the user under such loose-fit condition, the selected portion deforms from its preformed circular shape so that much of the cap periphery is not subjected to any rotational or twisting force while the user grips the exterior face of the selected portion. Further, even if the diameter of one of the ring-like portions was such as to provide a close fit on a container cap, the user would have to apply substantially the same force to the exterior face of the portion to remove the cap as would be required if the user attempted to remove the cap directly by hand. Such result follows since the walls of the ring-like portions are relatively thin, viz.,about $\frac{1}{8}$ inch.

Until now, there has not been known a gripper device for container caps which device can accommodate effectively a large variety of caps having various sizes and shapes while affording the user at least some mechanical advantage during a cap removal operation. Further, there has not been known a container cap remover which requires only a minimum degree of manual exertion when used to remove extremely tight container caps and particularly small-sized odd shaped caps such as used on tubes containing glue.

SUMMARY OF THE INVENTION

An object of the present invention is to overcome the above and other shortcomings in the known prior screw or twist cap removers.

Another obJect of the invention is to provide a gripper for use with twist-type container caps which can be used comfortably even by persons whose hands may be physically impaired.

A further object of the invention is to provide a container cap gripper which can accommodate a wide range of cap sizes and shapes and yet perform equally well in removing any of them from a container.

Still another object of the invention is to provide a gripper for container caps which is relatively simple to manufacture and can be made from low-cost materials.

Another object of the invention is to provide a gripper for container caps which provides the user with at least some mechanical advantage so as to reduce the twist force exerted by the user's hand as compared to that which would be required if the user attempted to remove the cap directly.

According to the invention, a gripper for container caps includes a generally solid body of rubber-like resilient material, the body having a recess for receiving container caps of different sizes over a certain range of cap sizes. The body material in the region of the recess is sufficiently elastic to conform substantially to the periphery of an inserted container cap of any size within said certain range when the cap is urged into the recess. Accordingly, the material firmly grips the cap and applies an opening force to a substantial part of the cap periphery in response to a twist of the user's hand when the cap is restrained by its associated container from rotating along with the gripper body.

The various features of novelty which characterize the invention are pointed out with particularity in the claims annexed to and forming a part of the present disclosure. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE INVENTION

Figure 1:
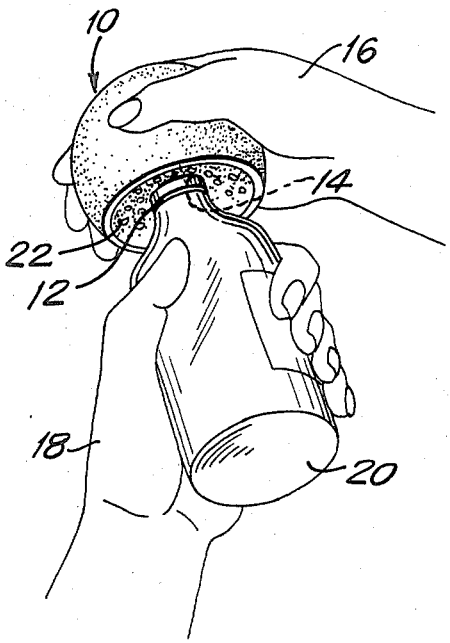
FIG. 1 is a perspective view of the container cap gripper of the invention while used to remove a bottle cap.

FIG. 1 shows a gripper 10 according to the invention, being used to remove a bottle cap 12 after the cap 12 has been inserted into a recess 14 formed in the body of the gripper 10. After insertion of the cap 12 in the recess 14, a twisting force is applied to the gripper body by one hand 16 of the user, while the remaining hand 18 holds a bottle 20 from which the cap 12 is to be removed. The gripper 10 of the invention may also be used, if desired, to tighten the bottle cap 12 or any other twist or screw type container cap onto its associated container if the container contents are not entirely consumed and it is desired to re-cap the container to the original degree of tightness.

FIGS. 2–5 show various embodiments of the container cap gripper of the present invention.

Figure 2:
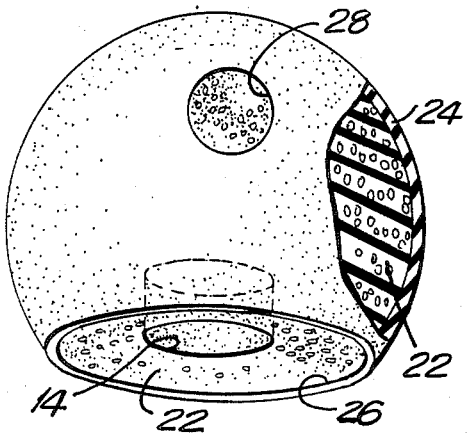
FIG. 2 is an enlarged, partly sectional view of the gripper, showing a version having various shaped recesses for receiving different sized container caps.

As shown in FIG. 2, the container cap gripper 10 of the invention is formed of a generally solid body 22 of rubber-like resilient material. A preferred material is a closed cell foamed elastomer such as, for example, closed cell sponge rubber of the kind used for various recreation and household products. One elastomer of sufficient strength are the styrene-butadiene rubbers (SBR). It is contemplated that various natural and/or synthetic rubbers may be used to form the body 22 of the present cap gripper 10, provided they exhibit the particular characteristics described below.

An outer layer 24 may be fixed to the outer surface of the cap gripper body 22 so as to protect the exterior of the body 22 from damage, as well as to allow the body 22 to be acommodated comfortably in the palm of the user's hand 16 while the gripper 10 is used. Layer 24 may comprise, for example, a thin sheet rubber layer which is bonded by suitable adhesive to the outer surface of the gripper body 22. Further, in place of the layer 24, any other means fixed to the outer surface of the body 22 may be provided such as, e.g., a handle (not shown) in which the body 22 is inserted securely and which also conforms to the user's hand comfortably during use. The layer 24 shown in FIG. 2 may also be omitted entirely, provided the outer surface of the gripper body 22 is suitably finished to protect against damage with a texture which affords a comfortable "feel" to the user's hand.

As shown in the drawing, the body 22 of the present cap gripper is of generally spherical shape. In the embodiments of FIGS. 1–3 and 5, a crater or saucer-like recess 26 is formed in the gripper body 22. It has been discovered that if a container cap is urged into the recess 26 with sufficient force, the material forming the gripper body 22 will elastically deform and substantially envelop or conform to the outer periphery of the inserted container cap. It will be understood that under such conditions, any twist force imparted to the outer surface of the gripper body 22 by the user's hand 16 will be applied to a substantial part of the outer periphery of the cap while its associated container is held steady by the remaining hand 18. Accordingly, a significant mechanical advantage or increase in torque is realized when using the gripper 10 of the invention, as compared to when the user attempts to unscrew the cap directly by hand or even with the aid of one of the known sheet rubber types of cap removers.

Moreover, the nature of the material forming the gripper body 22 is such that it may accommodate caps of various shapes and within a certain range of sizes when urged into the recess 26. Such feature provides a distinct advantage over the known cap grippers or removing devices most all of which are designed to operate only with caps which have a circular outer periphery.

The elasticity or spongy property of the material of the cap gripper body 22 provides substantial gripping action and leverage particularly on small and very small container caps such as those on medicine bottles and tubes of toothpaste, glue and the like. It will be appreciated that such small caps can be removed by the gripper 10 without pain, particularly if the material forming the gripper 10 is spongy throughout. That is, the user is provided with a large, comfortable grip while exerting a twist force to open the cap, while in the past the smaller caps had to be gripped between the fingers of the user and, if the cap was extremely tight, the user would experience some pain and thus be detered from exerting full force. The result usually was to resort to a pair of pliers which in turn would gouge or crack the container cap while being removed. With the present cap gripper 10, however, the user can comfortably exert his or her full force to open even the smallest of container caps without ensuing damage or pain.

Figure 3:
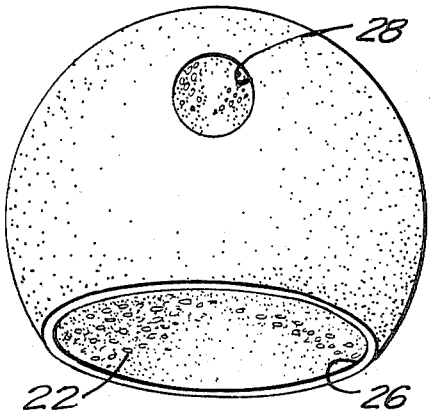
FIG. 3 is a view of another embodiment of the present container gap gripper like that shown in FIG. 2.
Figure 4:
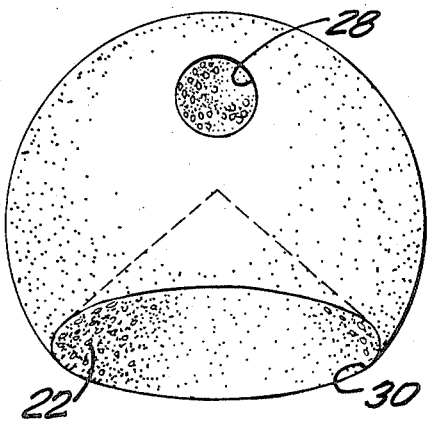
FIG. 4 is yet another embodiment of the present container cap gripper.

As shown in FIG. 2, the cylindrical or "bottle cap" recess 14 is provided in the central portion of the saucer recess 26. Although the bottle cap 12 in FIG. 1 may be removed even if urged into a continuous saucer-like recess 26 as shown in FIG. 3, the provision of the cylindrical recess 14 will allow the bottle cap 12 to be removed (or tightened) with less force than required for urging the cap 12 against the continuous wall of the recess 26 in FIG. 3. That is, if the diameter of the recess 14 is slightly less than the smallest size of bottle cap diameters expected to be encountered, the material of the gripper body 22 in the region of the recess 14 will firmly grip the cap 12 after the cap is pushed into the recess 14 and no further urging force is required. In fact, the bottle cap 12 may be left in place in the gripper body recess 14 so that it may be removed and retightened on the associated bottle 20 until the bottle contents are entirely consumed.

For the smaller sized caps such as used on tubes of toothpaste, glue and the like, a conical recess 28 may be formed in the outer surface of the gripper body 22, separate from the recess 26 as shown in FIGS. 2 & 3. The gripper 10 in the embodiment shown in FIG. 4 also has a large conical recess 30 rather than the saucer-like recess 26. It will be understood that the provision of a conical rather than a saucer-like recess may increase the effectiveness of the gripper 10 in removing container caps having a circular outer periphery, but may have some limiting effect on the variety of cap shapes which can be accommodated when the gripper 10 has the saucer-like recess 26 formed in its body 22.

Figure 5:
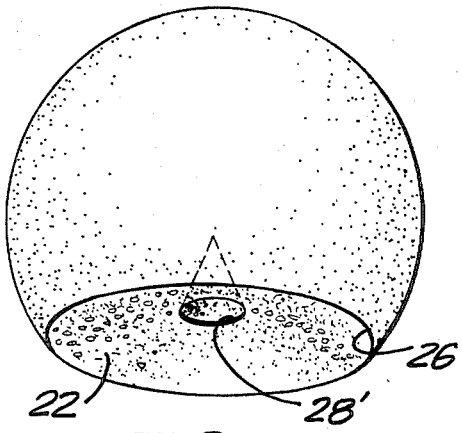
FIG. 5 is still another embodiment of the container cap gripper of the invention.

In the embodiment of FIG. 5, a small conical recess 28' is provided in the central portion of the saucer-like recess 26.

The particular locations and relative sizes of the various recesses 26, 28 and 30 may be selected as desired. For example, in the FIG. 4 embodiment, the open face of the large conical recess 30 may almost coincide with the plane of a major circumference of the gripper body 22. The apex of the recess 30 will likewise be moved upward within and closer to the top of the gripper body 22 as it appears in FIG. 4. Also, the gripper 10 need not be exactly in the form of a sphere or part of a sphere, but could vary somewhat provided it may still be comfortably held while in use.

It is contemplated that the gripper 10 be manufactured by a molding process with the desired recesses formed in the gripper body 22 by way of the mold. It is preferred that a smooth transition be formed between the opening faces of the recesses and the outer surface of the gripper 10 so as to avoid tearing when a container cap is urged into one of the recesses. Such rounded edges may also be provided for in the molding process.

For smaller sized caps used on large-bodied containers, providing of the small conical recess 28 separate from other recesses in the gripper body 22 is preferred, so as to avoid interference between the container body and the surrounding portion of the gripper body 22.

While specific embodiments of the invention have been shown and described in detail to illustrate the application of the inventive principles, it will be understood that the invention may be embodied otherwise without departing from such principles.

I claim:

1. A gripper for facilitating the removal and tightening of container caps comprising:

a generally solid spherical body of resilient material adapted for palm-fitting, hand-held engagement, said body defining at least one recess in an outer surface of the body, said recess extending radially within the body, means for applying a radial inwardly directed palm and finger generated pressure on the outer surface of the body, said pressure being effective for conforming the recess to the cap and for providing frictional engagement therewith, and means for applying a turning force to the spherical body to develop a mechanical advantage rotational torque upon the cap.

2. A gripper as claimed in claim 1, wherein the conformable means comprises an elastomer material.

3. A gripper as claimed in claim 2, wherein the elastomer material is closed cell sponge rubber.

4. A gripper as claimed in claim 1, wherein the recess is cylindrically shaped.

5. A gripper as claimed in claim 1, wherein said body has two separate recess for receiving container caps of different size ranges.

6. A gripper as claimed in claim 1, wherein the recess includes an outer region having a saucer-like shape and a central portion having a cylindrical shape.

7. A gripper as claimed in claim 1, wherein the recess is conically shaped.

8. A gripper as claimed in claim 1, wherein the recess includes an outer region having a saucer-like shape and a central portion having a conical shape.

* * * * *